US011675291B2

(12) United States Patent
Tanaka

(10) Patent No.: US 11,675,291 B2
(45) Date of Patent: Jun. 13, 2023

(54) IMAGE FORMING APPARATUS

(71) Applicant: Brother Kogyo Kabushiki Kaisha, Nagoya (JP)

(72) Inventor: Tokifumi Tanaka, Komaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/650,893

(22) Filed: Feb. 14, 2022

(65) Prior Publication Data

US 2022/0269196 A1 Aug. 25, 2022

(30) Foreign Application Priority Data

Feb. 19, 2021 (JP) ..... JP2021-025179

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
See application file for complete search history.

(56) References Cited

U.S. PATENT DOCUMENTS

2009/0162116 A1 6/2009 Mogi et al.
2018/0081311 A1 3/2018 Kawakami

FOREIGN PATENT DOCUMENTS

JP 2004-198655 A 7/2004
JP 2009-151118 A 7/2009
JP 2017090885 A * 5/2017 ..... G03G 15/2025
JP 2018-049101 A 3/2018

* cited by examiner

*Primary Examiner* — Victor Verbitsky
(74) *Attorney, Agent, or Firm* — Burr Patent Law, PLLC

(57) ABSTRACT

An image forming apparatus includes an endless belt, a roller configured to rotate the endless belt by rotating in a state in which the roller is in contact with an outer circumferential surface of the endless belt, a heater, a pressure pad configured to nip the endless belt between the pressure pad and the roller to form a nip portion, a sliding sheet interposed between an inner circumferential surface of the endless belt and the pressure pad. The image forming apparatus is configured to execute a fixing operation in which a developer image on a sheet is fixed in a state in which the sheet is nipped between the roller and the endless belt. A nip pressure at the nip portion P [MPa] and a peripheral velocity of the endless belt V [mm/sec] satisfies V/P≥200 when the image forming apparatus executes the fixing operation.

12 Claims, 10 Drawing Sheets

FIG.10

VALUE OF V/P [mm/(MPa·sec)] AND DETERMINATION RESULT OF ABNORMAL NOISE

| | | PERIPHERAL VELOCITY OF ENDLESS BELT [mm/sec] | | | | |
|---|---|---|---|---|---|---|
| | | 30 | 60 | 79.2 | 120 | 240 |
| MAXIMUM NIP PRESSURE [MPa] AT NIP PORTION | 0.29 | 103 NG | 207 Good | 275 Good | 414 Good | 828 Good |
| | 0.38 | 79 NG | 158 NG | 208 Good | 316 Good | 632 Good |
| | 0.43 | 70 NG | 140 NG | 184 NG | 279 Good | 558 Good |

IMAGE FORMING APPARATUS

CROSS REFERENCE TO RELATED APPLICATION

The present application claims priority from Japanese Patent Application No. 2021-025179, which was filed on Feb. 19, 2021, the disclosure of which is herein incorporated by reference in its entirety.

BACKGROUND

The following disclosure relates to an image forming apparatus including a fixing device that fixes a developer image on a sheet.

There has been known the fixing device used for the image forming apparatus and configured to fix the developer image on the sheet. The fixing device forms a nip portion in which an endless belt is nipped between a rotating member and a pressure pad. A sliding sheet for reducing friction is disposed between the endless belt and the pressure pad. Heat-resistant resin is used for the endless belt and the sliding sheet.

SUMMARY

Incidentally, in a case where the heat-resistant resin is used for both the endless belt and the sliding sheet, adhesion may occur between the resins of the endless belt and the sliding sheet; therefore, there is a case where stick-slip in which a stick (fixation) state and a slip (sliding) state are alternately repeated between the endless belt and the sliding sheet occurs. When the slick-slip occurs, abnormal noise may occur, and wear between the endless belt and the sliding sheet may increase.

In view of the above, an aspect of the disclosure relates to an image forming apparatus capable of suppressing slick-slip which occurs between the endless belt and the sliding sheet.

In one aspect of the disclosure, an image forming apparatus includes an endless belt made of heat-resistant resin not containing fluorine and having a glass transition temperature of 140° C. or more, a roller configured to rotate the endless belt by rotating in a state in which the roller is in contact with an outer circumferential surface of the endless belt, a heater configured to heat at least one of the roller and the endless belt, and a pressure pad configured to nip the endless belt between the pressure pad and the roller to form a nip portion, and a sliding sheet interposed between an inner circumferential surface of the endless belt and the pressure pad, the sliding sheet being made of heat-resistant resin not containing fluorine and having the glass transition temperature of 140° C. or more. The image forming apparatus is configured to execute a fixing operation in which a developer image on a sheet is fixed in a state in which the sheet is nipped between the roller and the endless belt. A nip pressure at the nip portion P [MPa] and a peripheral velocity of the endless belt V [mm/sec] satisfies $V/P \geq 200$ when the image forming apparatus executes the fixing operation.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which:

FIG. 10 is a chart illustrating values of V/P and determination results of abnormal noise in a case where the maximum nip pressure at the nip portion and a peripheral velocity of the endless belt are changed.

EMBODIMENTS

Next, an embodiment of the present disclosure will be explained in detail suitably with reference to the drawings.

Figure 1:
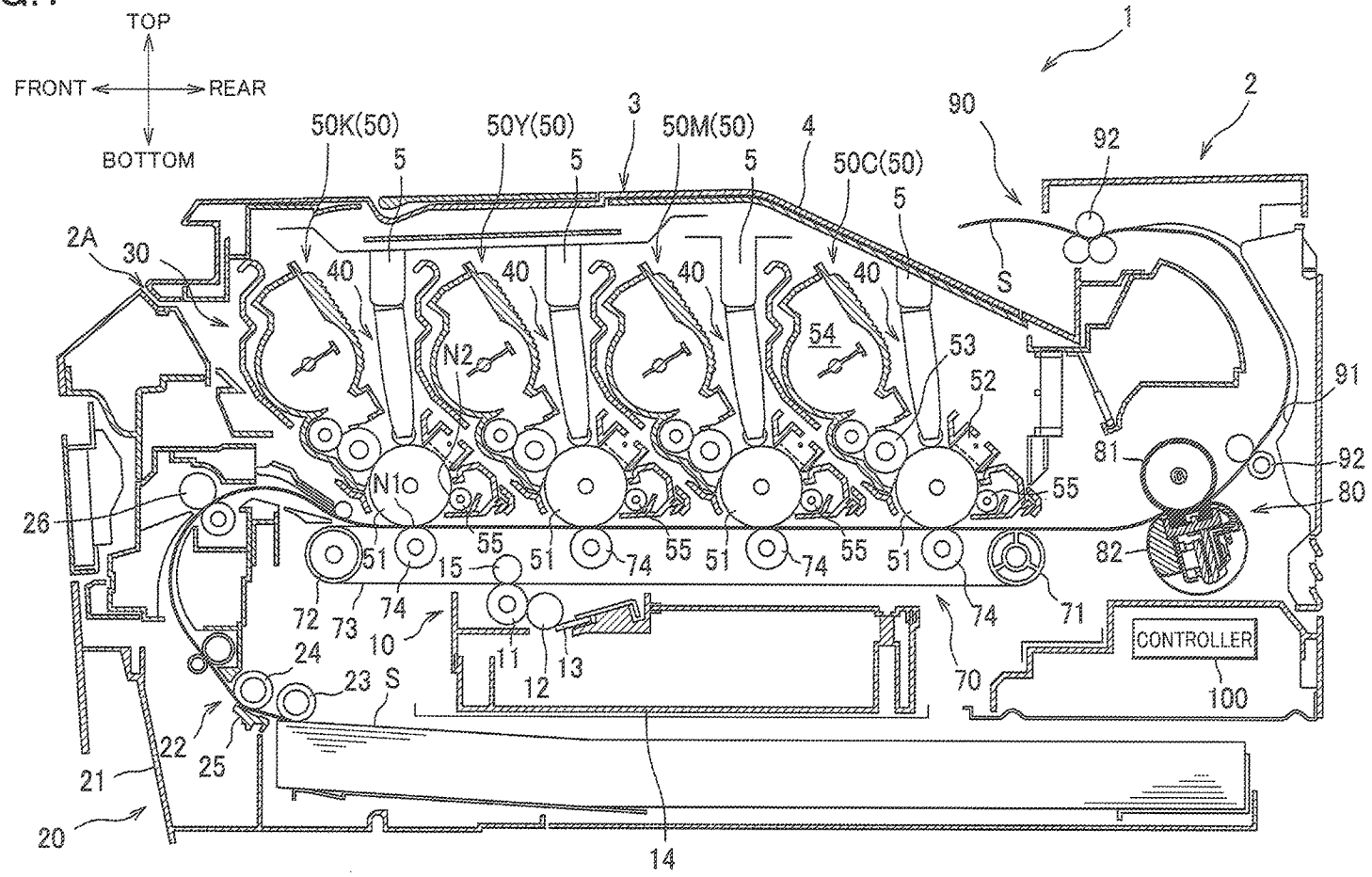
FIG. 1 is a cross-sectional view illustrating a color printer according to an embodiment of the present disclosure.

As illustrated in FIG. 1, a color printer 1 as an example of an image forming apparatus includes a supplier 20 configured to supply a sheet S into a body housing 2, an image forming unit 30 configured to form a toner image on the sheet, a fixing device 80 configured to fix the toner image on the sheet S, a discharge portion 90 configured to discharge the sheet S on which the image is formed, and a controller 100.

An opening 2A is formed at an upper part of the body housing 2, and the opening 2A is opened/closed by an upper cover 3 which is pivotably supported by the body housing 2. An upper surface of the upper cover 3 is a discharge tray 4 on which the sheet S discharged from the body housing 2 is stacked. A plurality of LED mounting members 5 for holding LED units 40 are provided below the upper cover 3.

The supplier 20 is provided at a lower part in the body housing 2, and the supplier 20 includes a supply tray 21 mountable/detachable to/from the body housing 2 and a supply mechanism 22 configured to convey the sheet S from the supply tray 21 to the image forming unit 30. The supply mechanism 22 includes a pickup roller 23, a separation roller 24, a separation pad 25, and a registration roller 26.

In the supplier 20, the sheet S in the supply tray 21 is fed by the pickup roller 23. Next, the sheet S is separated one by one by the separation roller 24 and the separation pad 25. After that, the registration roller 26 conveys the sheets toward the image forming unit 30 after aligning a position of a distal end of the sheet S. Specifically, the registration roller 26 comes into contact with the conveyed sheet S in a stopped state to align the position of the distal end of the sheet S, and feeds the sheet S by starting rotation.

The image forming unit 30 includes four LED units 40, four process cartridges 50, a transfer unit 70, and a belt cleaner 10.

Each of the LED units 40 is connected so as to be pivotable with respect to the a corresponding one of the LED mounting members 5, and the LED units 40 are supported by positioning members provided in the body housing 2 so as to be suitably positioned.

The process cartridges 50 are arranged side by side in a front and rear direction between the upper cover 3 and the supplier 20. The process cartridge 50 is configured so that the process cartridge 50 includes a photoconductive drum 51 as an example of a photoconductor, a charging unit 52, a developing roller 53, a toner container 54 containing toner as an example of a developer, a cleaning roller 55, and the like.

The process cartridges 50 illustrated by symbols 50K, 50Y, 50M, and 50C containing toners of respective colors for black, for yellow, for magenta, and for cyan are arranged side by side in this order from an upstream side in a conveying direction of the sheet S. In a case where the photoconductive drum 51, the developing roller 53, the cleaning roller 55, and the like each corresponding to one of colors of toner are distinguished in the specification and drawings, symbols K, Y, M, and C are given respectively corresponding to black, yellow, magenta, and cyan.

The photoconductive drum 51 is a member capable of bearing toner. Specifically, a portion, of a surface of the photoconductive drum 51, which has been exposed by the LED unit 40 bears toner. The photoconductive drums 51 are respectively provided at the plurality of process cartridges 50. The photoconductive drums 51 are arranged in a row along the conveying direction of the sheet S.

The developing roller 53 is a roller that bears toner. The developing roller 53 is configured to come into contact with the photoconductive drum 51 so as to supply toner to an electrostatic latent image on the photoconductive drum 51.

The cleaning roller 55 is a member capable of collecting toner on the photoconductive drum 51. Each of the cleaning rollers 55 is provided adjacent to a corresponding one of the photoconductive drums 51.

The transfer unit 70 is provided between the supplier 20 and respective process cartridges 50, and the transfer unit 70 includes a drive roller 71, a driven roller 72, a belt 73, and transfer rollers 74.

The drive roller 71 and the driven roller 72 are disposed in parallel so as to be spaced apart from each other in the front and rear direction, and the endless belt 73 is wound therebetween. The belt 73 is a member configured to convey the sheet S. An outer circumferential surface of the belt 73 is in contact with the photoconductive drums 51. Four transfer rollers 74 are disposed inside the belt 73 so as to be opposed to respective photoconductive drums 51.

The belt 73 is interposed between the transfer rollers 74 and the photoconductive drums 51. The sheet S is conveyed by the belt 73 and the photoconductive drums 51.

The belt cleaner 10 is a device configured to collect toner and the like adhering on the belt 73 by sliding contact of the belt cleaner 10 on the belt 73, and the belt cleaner 10 is disposed below the belt 73. Specifically, the belt cleaner 10 includes a sliding-contact roller 11, a collecting roller 12, a blade 13, and a waste-toner container 14.

The sliding-contact roller 11 is disposed so as to be in contact with the outer circumferential surface of the belt 73. The belt 73 is interposed between the sliding-contact roller 11 and a backup roller 15. The sliding-contact roller 11 collects particles adhering on the belt 73.

The collection roller 12 is a roller configured to slide and contact the sliding-contact roller 11, and configured to collect the particles adhering on the sliding-contact roller 11. Then, the particles on the collecting roller 12 are scraped by the blade 13 disposed so that the blade 13 slides and contacts the collecting roller 12, and the particles enter the waste-toner container 14.

The fixing device 80 includes a rotating member 81 and a belt unit 82. The structure of the fixing device 80 will be explained in detail below.

In the image forming unit 30 configured as described above, surfaces of the photoconductive drums 51 are uniformly charged by the charging units 52 first, then, exposed by the LED units 40. Accordingly, electrostatic latent images based on image data are formed on the photoconductive drums 51. After that, toner is supplied to the electrostatic latent images by the developing rollers 53, toner images are born on the photoconductive drums 51.

When the sheet S supplied on the belt 73 passes between the photoconductive drums 51 and the transfer rollers 74 disposed inside the belt 73, the toner images formed on the photoconductive drums 51 are transferred on the sheet S. Then, the sheet S passes between the rotating member 81 and the belt unit 82 to thereby heat-fix the toner image transferred onto the sheet S.

The discharge portion 90 includes an discharge-side conveying path 91 and a plurality of conveying rollers 92. The sheet S on which the toner image is heat-fixed is conveyed to the discharge-side conveying path 91 by the conveying rollers 92 and discharged to the outside of the body housing 2 to be stacked on the discharge tray 4.

Figure 2:
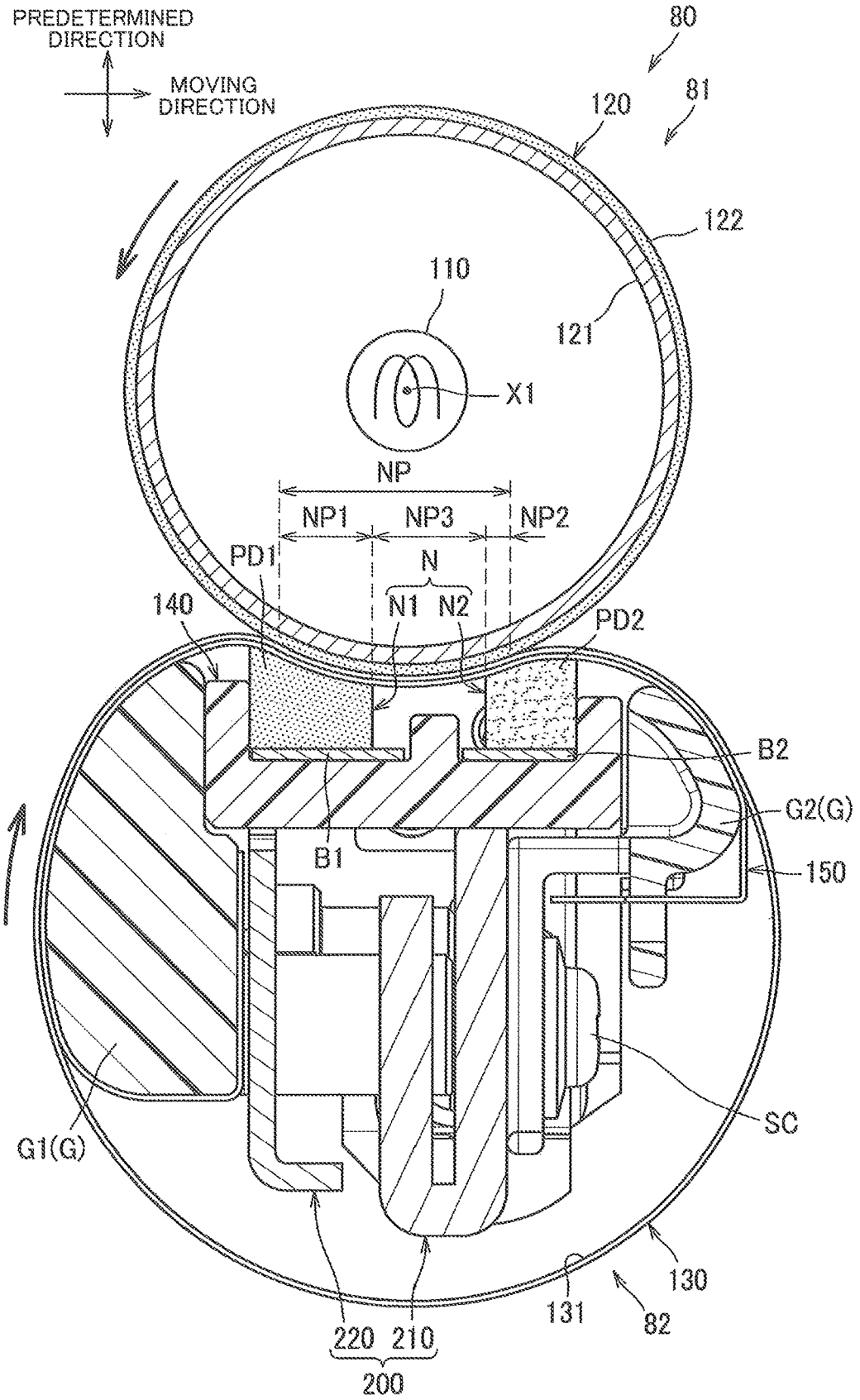
FIG. 2 is a cross-sectional view illustrating a fixing device.

As illustrated in FIG. 2, the fixing device 80 includes a heater 110, the rotating member 81, the belt unit 82, and a later-described pressure change mechanism 300 (refer to FIG. 5). The belt unit 82 is urged toward the rotating body 81 by the later-described pressure change mechanism 300. In the following explanation, a direction in which the belt unit 82 is urged toward the rotating member 81 is called a "predetermined direction". The predetermined direction is a direction orthogonal to a width direction and a moving direction which will be described below, and the predetermined direction is a direction in which the rotating member 81 is opposed to the belt unit 82 in the embodiment.

The rotating member 81 includes a rotatable roller 120. The belt unit 82 is a member configured to form a nip portion NP between the belt unit 82 and the rotating member 81. The belt unit 82 includes an endless belt 130, a pressure pad N, a holder 140, a stay 200, a belt guide G, and a sliding sheet 150. In the following explanation, a width direction of the endless belt 130 is referred to merely as a "width direction". The width direction is a direction in which a rotating axis of the roller 120 extends, namely, an axial direction of the roller 120. The width direction is orthogonal to the predetermined direction.

The heater 110 is a halogen lamp, and configured to emit light and generate heat by energization to thereby heat the roller 120 by radiant heat. The heater 110 is disposed inside the roller 120 along the rotating axis of the roller 120. The heater 110 is located inside the rotating member 81 and configured to heat the rotating member 81 in the embodiment.

The roller 120 is a cylindrical roller elongated in the width direction, the roller 120 is heated by the heater 110. The roller 120 includes a tube blank 121 made of metal or the like and an elastic layer 122 covering an outer circumferential surface of the tube blank 121. The elastic layer 122 is made of rubber such as silicone rubber. The roller 120 is rotatably supported by later-described side frames 83 (refer to FIG. 5), and the roller 120 is driven to rotate counter-clockwise in FIG. 2 when a drive force is inputted from a fixing motor M2 (refer to FIG. 8) provided in the body housing 2.

The endless belt 130 is a long cylindrical member, having flexibility. The endless belt 130 includes a base material which is a film material constituting a body of the endless belt 130 and a coat layer provided on the surface of the base material.

The base material of the endless belt 130 is made of heat-resistant resin not containing fluorine and having a glass transition temperature of 140° C. or more. In the embodiment, the base material of the endless belt 130 is made of polyimide (glass transition temperature 220° C.). The base material of the endless belt 130 may be mainly made of polyimide and may contain fine particles of carbon or the like for giving conductivity. The coat layer of the endless belt 130 is made of fluorine resin (PFA, PTFE, and the like), and the coat layer is provided on a surface which is in contact with the roller 120.

The endless belt 130 is configured to cooperate with the rotating member 81, specifically, the roller 120, to form the nip portion NP. The endless belt 130 is in contact with an outer circumferential surface of the rotating member 81 and is driven to rotate with rotation of the rotation member 81. The pressure pad N, the holder 140, the stay 200, the belt guide G, and the sliding sheet 150 are disposed inside the endless belt 130.

That is, the pressure pad N, the holder 140, the stay 200, the belt guide G, and the sliding sheet 150 are covered with the endless belt 130.

Figure 3:
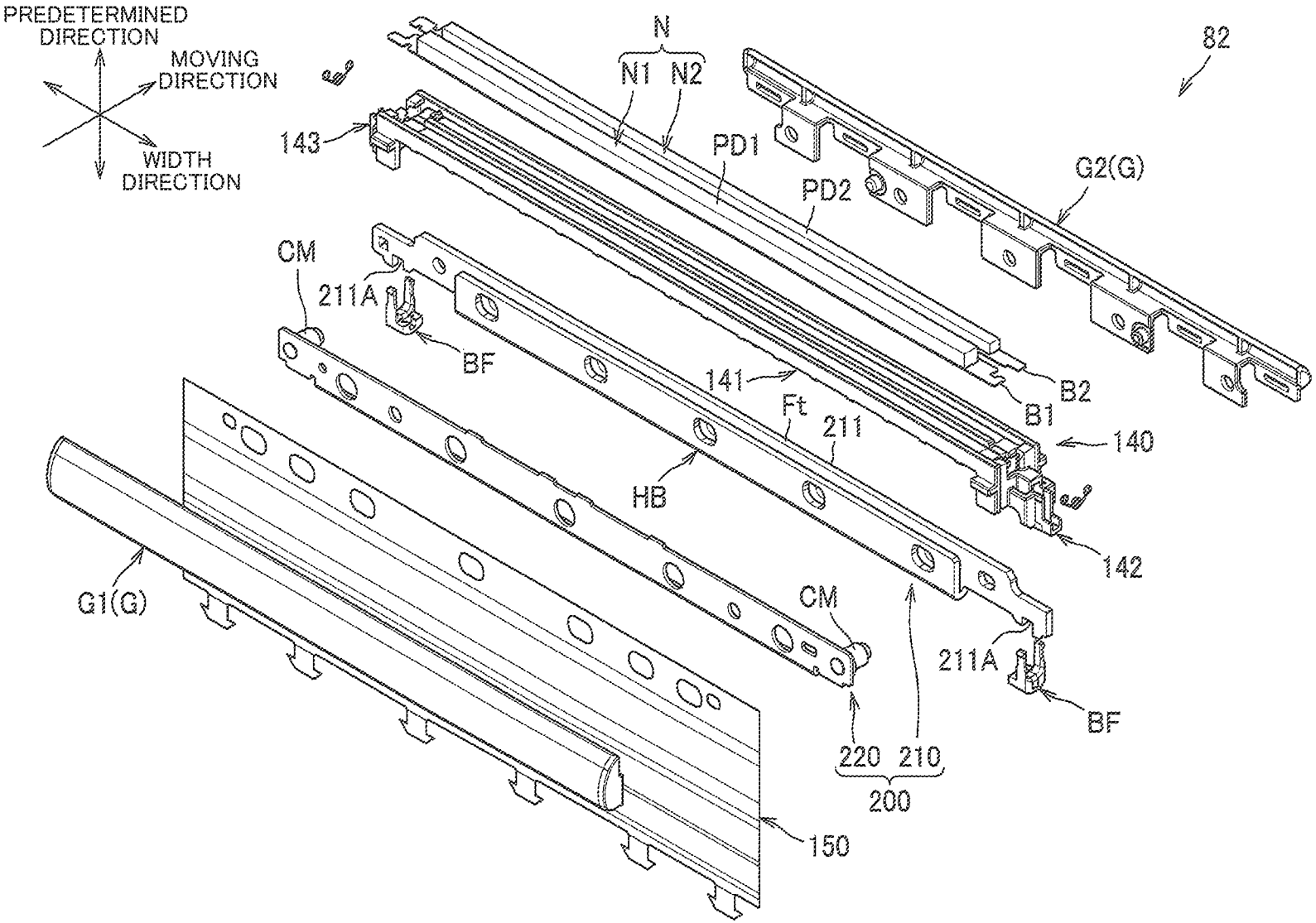
FIG. 3 is an exploded perspective view illustrating respective members disposed inside an endless belt in the fixing device.

As illustrated in FIG. 2 and FIG. 3, the pressure pad N is a member configured to form the nip portion NP in which the endless belt 130 is interposed between the pressure pad N and the rotating member 81. The pressure pad N includes a first pressure pad N1 and a second pressure pad N2.

The first pressure pad N1 includes a first pad PD1 and a first fixing plate B1. The first pad PD1 is a member having a rectangular parallelepiped shape. The first pad PD1 is made of rubber such as silicone rubber. The first pad PD1 forms a first nip portion NP1 in which the endless belt 130 is interposed between the first pad PD1 and the rotating member 81.

In the following explanation, a moving direction of the endless belt 130 in the first nip portion NP1 and the later described nip portion NP is referred to merely as a "moving direction". In the embodiment, the moving direction is a direction along the outer circumferential surface of the roller 120, and this direction is along a direction almost orthogonal to the predetermined direction and the width direction; therefore, the direction is illustrated as the direction orthogonal to the predetermined direction and the width direction. The moving direction is the same direction as the conveying direction of the sheet S in the nip portion NP.

The first pad PD1 is fixed to a surface of the first fixing plate B1 located on the roller 120 side. The first fixing plate B1 is made of a member more rigid than the first pad PD1, and the first fixing plate B1 is, for example, made of metal or the like.

The second pressure pad N2 is disposed so as to be spaced apart from the first pressure pad N1 on a downstream side in the conveying direction. The second pressure pad N2 includes a second pad PD2 and a second fixing plate B2.

The second pad PD2 is a member having a rectangular parallelepiped shape. The second pad PD2 is made of rubber such as silicone rubber. The second pad PD2 forms a second nip portion NP2 in which the endless belt 130 is interposed between the second pad PD2 and the rotating member 81. The second pad PD2 is spaced apart from the first pad PD1 in the rotating direction of the endless belt 130.

Accordingly, there exists an intermediate nip portion NP3, between the first nip portion NP1 and the second nip portion NP2, on which pressure from the belt unit 82 does not directly act. In the intermediate nip portion NP3, there is no member configured to cooperate with the roller 120 to nip the endless belt 13 while the endless belt 130 is in contact with the roller 120; therefore, pressure is hardly applied. Therefore, the sheet S passes the intermediate nip portion NP3 almost without being pressurized while being heated by the roller 120. In the embodiment, an area from an upstream end of the first nip portion NP1 to a downstream end of the second nip portion NP2, namely, the area where the outer circumferential surface of the endless belt 130 is in contact with the roller 120 is called the nip portion NP. That is, the nip portion NP includes the portion, which is the above described intermediate nip portion NP3, where a pressing force from the first pad PD1 and the second pad PD2 is not applied.

The second pad PD2 is fixed to a surface of the second fixing plate B2 located on the roller 120 side. The second fixing plate B2 is made of a member more rigid than the second pad PD2, and the second fixing plate member B2 is, for example, metal or the like.

A durometer hardness of the first pad PD1 is higher than a durometer hardness of the elastic layer 122 of the roller 120. Moreover, a durometer hardness of the second pad PD2 is higher than the durometer hardness of the first pad PD1.

Here, the durometer hardness is prescribed in ISO7619-1. The durometer hardness is a value obtained from a pushing depth of a prescribed push needle at the time of pushing the push needle into a test piece under prescribed conditions. For example, in a case where the durometer hardness of the elastic layer 122 is 5, the durometer hardness of the first pad P1 is preferably 6 to 10, and the durometer hardness of the second pad P2 is preferably 70 to 90.

The holder 140 is a member holding the pressure pad N. The holder 140 is made of resin with heat resistance. The holder 140 includes a holder body 141 and two engaging portions 142, 143.

The holder body 141 is a portion holding the pressure pad N. Most part of the holder body 141 is disposed within a range in which the endless belt 130 exists in the width direction. The holder body 141 is supported by the stay 200.

The respective engaging portions 142, 143 extend from respective end portions of the holder body 141 in the width direction. The respective engaging portions 142, 143 are disposed out of the range in which the endless belt 130 exists in the width direction. The respective engaging portions 142, 143 engage with respective end portions of a later-described first stay 210 in the width direction.

The stay 200 is a member located on an opposite side of the pressure pad N with respect to the holder 140 and supporting the holder 140. The stay 200 includes the first stay 210 and a second stay 220 connected to the first stay 200 by connecting members CM.

The first stay 210 is a member supporting the holder body 141 of the holder 140. The first stay 210 is made of metal or the like. The first stay 210 includes a base portion 211 and a hemming bending portion HB which is bent by a hemming process.

The base portion 211 includes a contact surface Ft which is in contact with the holder body 141 of the holder 140 located at one end portion on the holder 140 side. The contact surface Ft is a plane perpendicular to the predetermined direction.

The base portion 211 includes load input portions 211A configured to receive the force from the later-described pressure change mechanism 300 (refer to FIG. 5) respectively located at both end portions of the base portion 211 in the width direction. The load input portions 211A are recesses opening to an opposite side of the pressure pad N in the predetermined direction, and each of the load input portions 211 is formed at an end portion of the base portion 211 on the opposite side of the pressure pad N in the predetermined direction.

Buffer members BF made of resin or the like are mounted to the load input portions 211A. The buffer members BF are members configured to suppress friction between the base portion 211 made of metal and later-described arms 310 (refer to FIG. 5) made of metal.

The belt guide G is a member for guiding an inner circumferential surface 131 of the endless belt 130. The belt guide G is made of resin with heat resistance. The belt guide G includes an upstream guide G1 and a downstream guide G2.

As illustrated in FIG. 2, the upstream guide G1, the downstream guide G2, and the first stay 210 are fastened together by a screw SC.

The sliding sheet 150 is a sheet having a rectangular shape and configured to reduce friction resistance between the first pad PD1/the second pad PD2 and the endless belt 130. The sliding sheet 150 is interposed between the inner circumferential surface 131 of the endless belt 130 and the first pad PD1/the second pad PD2 in the nip portion NP. The sliding sheet 150 is made of a material which can be elastically deformed. A base material of the sliding sheet 150 is made of heat-resistant resin not containing fluorine and having the glass transition temperature of 140° C. or more. In the embodiment, the base material of the sliding sheet 150 is made of polyimide (glass transition temperature 220° C.).

The sliding sheet 150 is constituted by the base material which is a film material constituting a body of the sliding sheet 150, and a coat layer is not formed on the surface of the sliding sheet 150. Accordingly, the base material of the sliding sheet 150 and the base material of the endless belt 130 are in contact with each other. The base material of the sliding sheet 150 may be mainly made of polyimide and may contain fine particles of carbon or the like for giving conductivity.

Figure 4A:
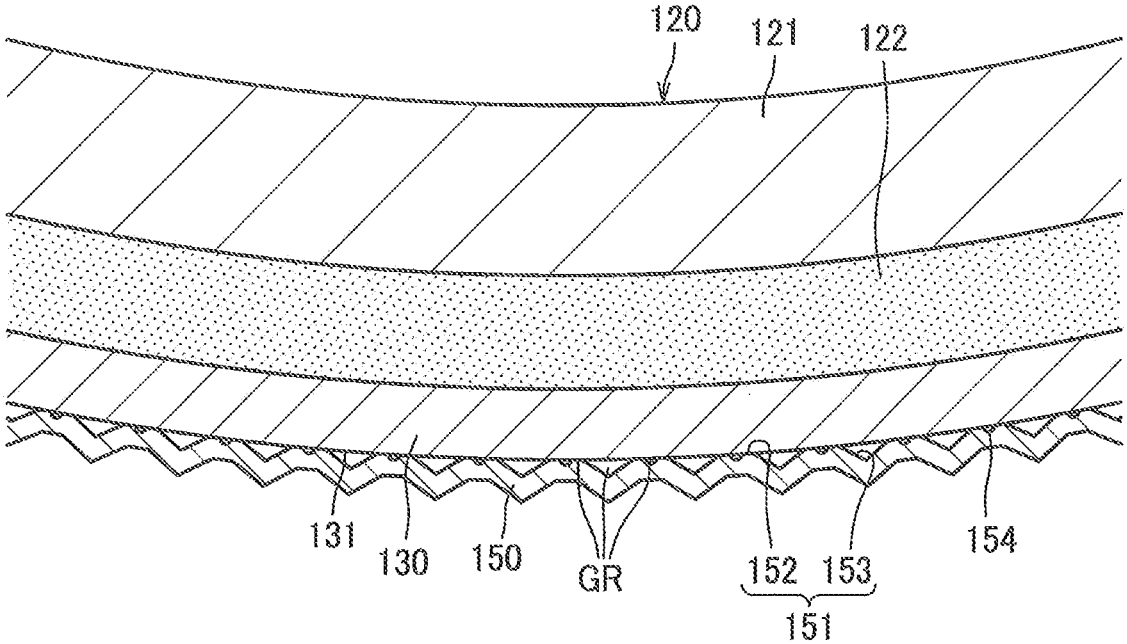
FIG. 4A is a partially enlarged view illustrating part of the endless belt and a sliding sheet in FIG. 2.
Figure 4B:
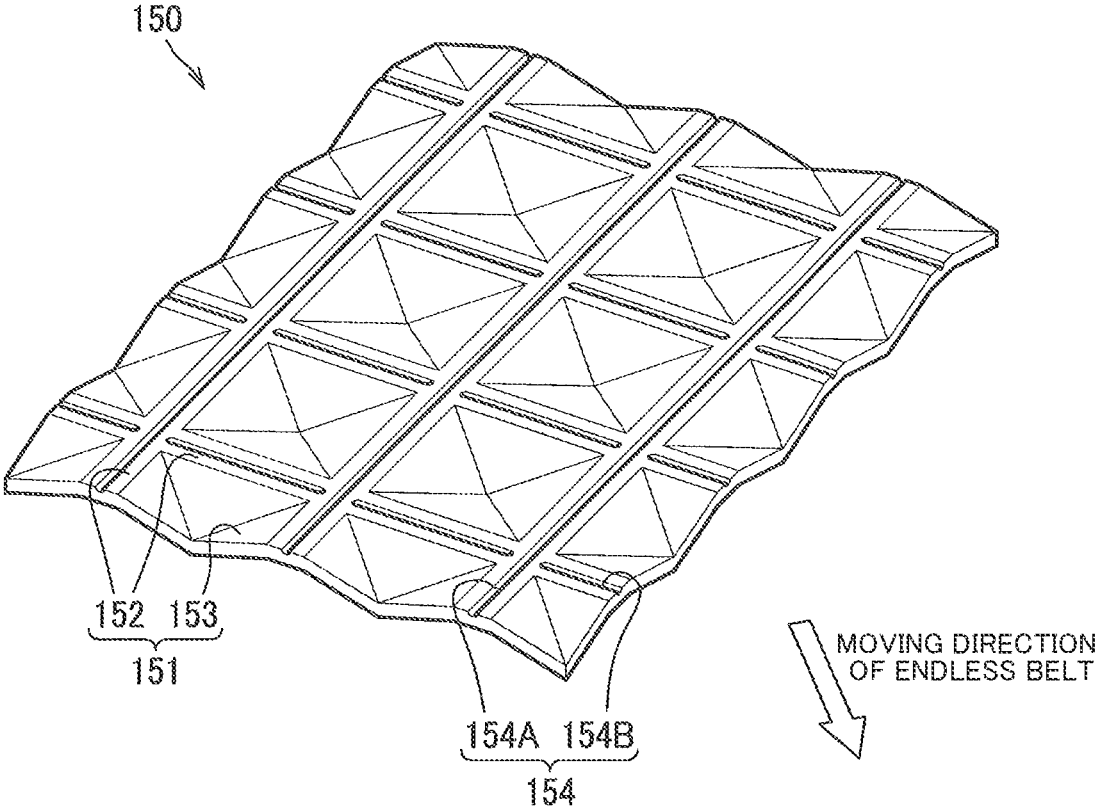
FIG. 4B is an enlarged perspective view illustrating an opposed surface of the sliding sheet.

As illustrated in FIGS. 4A, 4B, the sliding sheet 150 has a an opposed surface 151 which is opposed to the inner circumferential surface 131 of the endless belt 130. The opposed surface 151 is formed in an uneven shape in which sides of a plurality of polygons make ridges. In the embodiment, the opposed surface 151 is formed in the uneven shape in which sides of a plurality of squares make ridges. The opposed surface 151 includes a contact portion 152 which is in contact with the endless belt 130 and a plurality of recesses 153 which is not in contact with the endless belt 130.

A ratio of an area of the contact portion 152 in the opposed surface 151 of a predetermined area is equal to or less than 50%. The contact portion 152 is positioned at sides of squares formed in the opposed surface 151. The contact portion 152 obliquely extends with respect to a rotation direction, namely, the moving direction of the endless belt 130. In the contact portion 152, grooves 154 extending along directions in which the contact portion 152 extends are formed.

The grooves 154 obliquely extend with respect to the moving direction of the endless belt 130. A depth of the grooves 154 is 0.1 to 0.005 times of a depth of the recesses 153. The grooves 154 include first grooves 154A and second grooves 154B.

The recesses 153 are portions recessed from the contact portion 152 in a direction apart from the endless belt 130. The recesses 153 are surrounded by the contact portion 152. Since the contact portion 152 is formed to make squares, each recess 153 has a square pyramid shape, an apex of which is the bottom.

Grease GR is disposed between the endless belt 130 and the sliding sheet 150. The grease GR is for reducing friction between the endless belt 130 and the sliding sheet 150. The grease GR is positioned on the inner circumferential surface 131 of the endless belt 130, on the contact portion 152, in the recesses 153, and in the grooves 154 of the sliding sheet 150.

Here, the color printer 1 can change the maximum nip pressure at the nip portion NP at the time of fixing between a first nip pressure P1 and a second nip pressure P2 higher than the first nip pressure P1 by the pressure change mechanism 300. The first nip pressure P1 is the minimum nip pressure in a range of nip pressures changed by the pressure change mechanism 300, and the minimum nip pressure is a nip pressure to be set at the time of non-printing in which printing is not executed or to be set at the time of fixing an envelope and the like. The second pressure P2 is the maximum nip pressure in the range of nip pressures changed by the pressure change mechanism 300, and the maximum nip pressure is a nip pressure to be set at the time of normal printing, specifically, to be set when the toner image is fixed on plain paper and the like.

Figure 5:
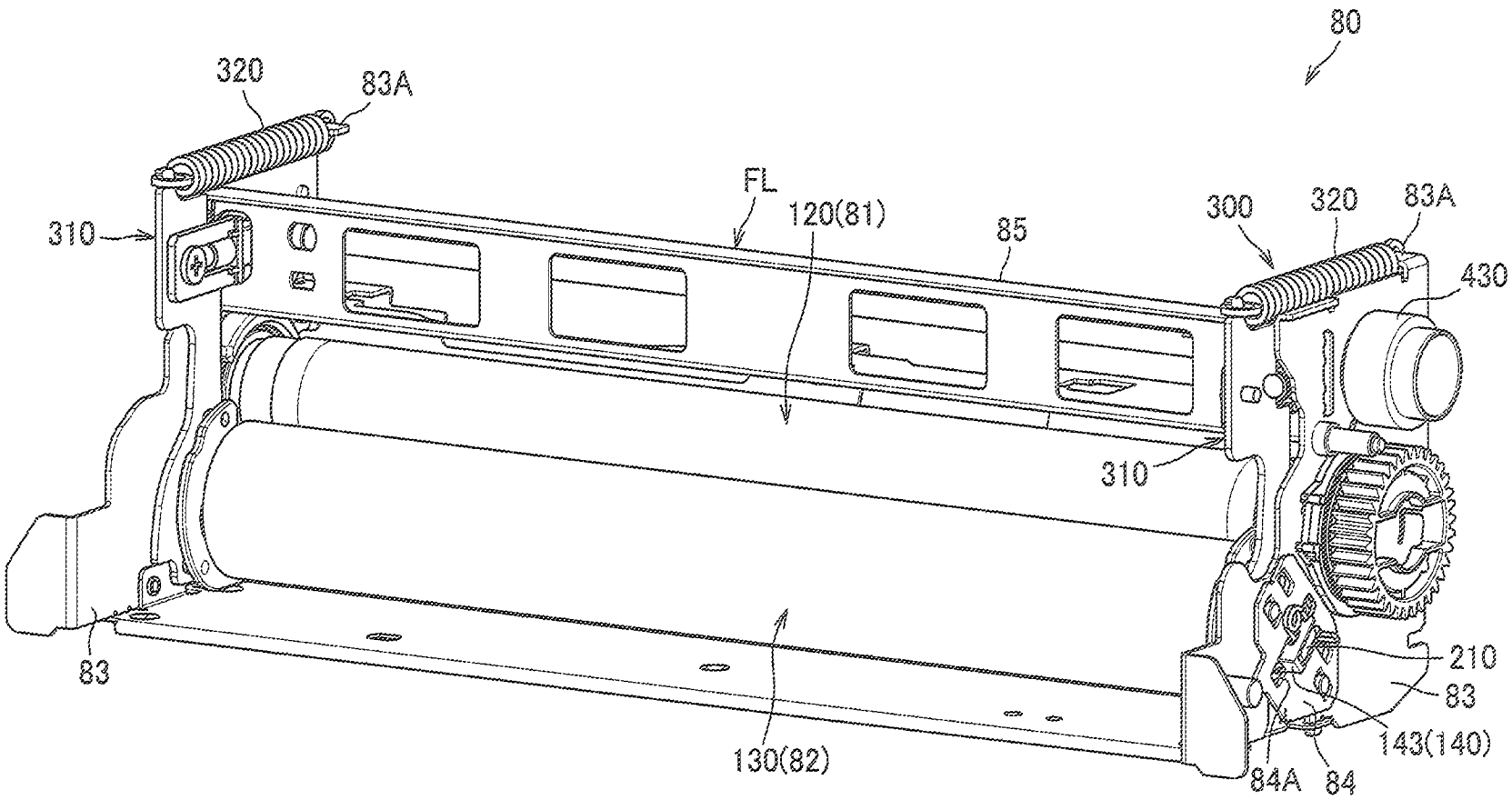
FIG. 5 is a perspective view illustrating a pressure change mechanism in the fixing device.

As illustrated in FIG. 5, the fixing device 80 further includes a frame FL and the pressure change mechanism 300. The frame FL is a frame supporting the rotating member 81 and the belt unit 82, and the frame FL is made of metal or the like. The frame FL includes the side frames 83 and brackets 84 respectively disposed on both sides of the rotating member 81 and the belt unit 82 in the width direction, and a connecting frame 85 connecting to each of the side frames 83.

The side frames 83 are frames supporting the rotating member 81 and the belt unit 82. Each of the side frames 83 has a spring engaging portion 83A configured to engage with one end portion of a later-described first spring 320.

The brackets 84 are members supporting the belt unit 82 so that the belt unit 82 is movable in the predetermined direction, and the brackets 84 are fixed to the side frames 83. Specifically, each of the brackets 84 includes a first long hole 84A supporting an end of the first stay 210 through the engaging portion 143 of the holder 140 so that the first stay 210 is movable in the predetermined direction. The first long hole 84A is a long hole elongated in the predetermined direction.

Figure 6A:
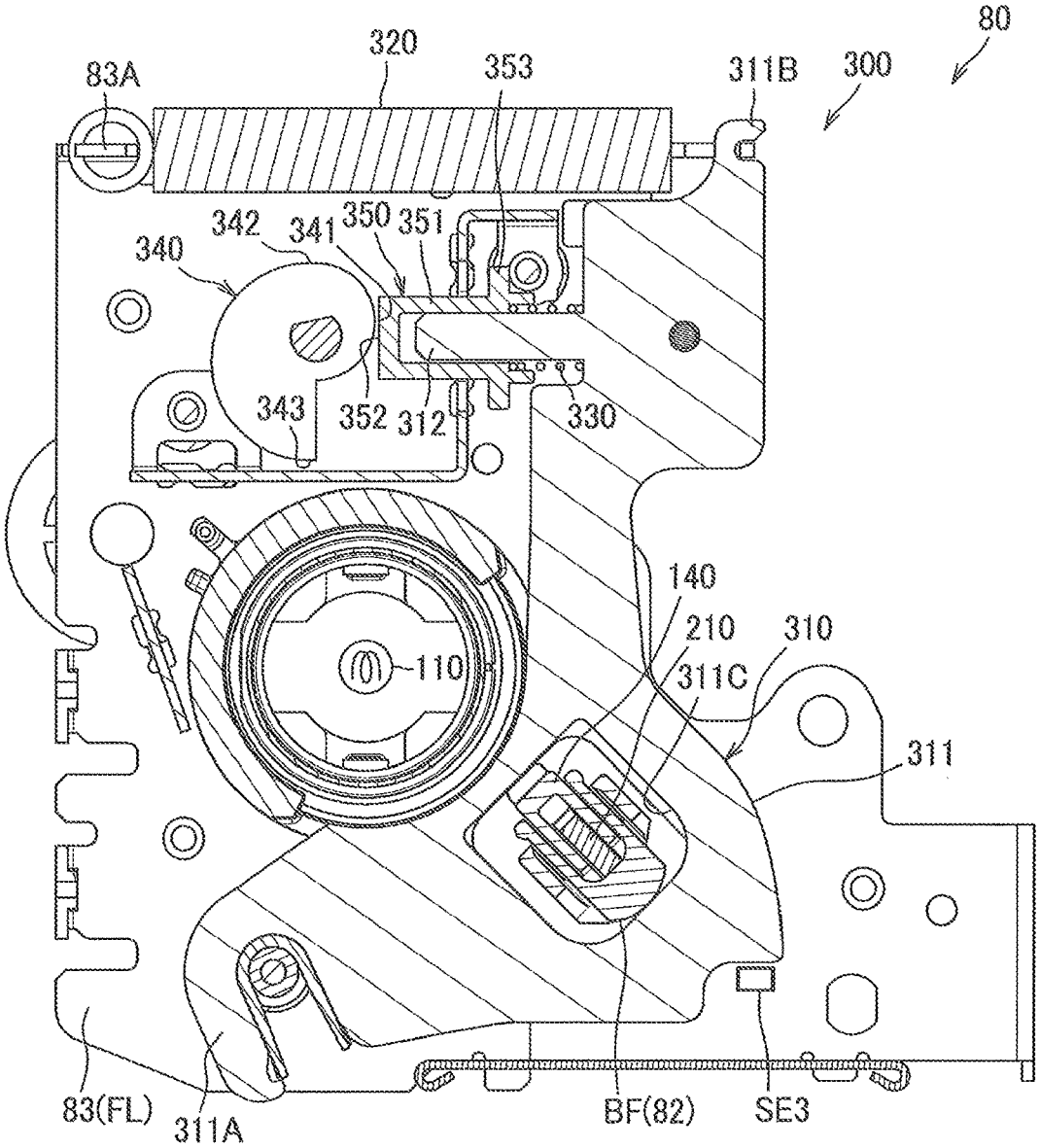
FIG. 6A is a cross-sectional view illustrating the pressure change mechanism obtained in a state in which a nip pressure is a second nip pressure.

The pressure change mechanism 300 is a mechanism configured to change the nip pressure at the nip portion NP. As illustrated in FIG. 5 and FIG. 6A, the pressure change mechanism 300 includes the arms 310, the first springs 320, second springs 330, and cams 340. The arms 310, the first springs 320, the second springs 330, and the cams 340 are provided at one end side and the other end side in the width direction of the frame FL, respectively.

The arm 310 is a member configured to press the first stay 210 through the buffer member BF. The arm 310 supports the belt unit 82 and is rotatably supported by the side frame 83.

The arm 310 has an arm body 311 and a cam follower 350. The arm body 311 is a plate member having a L-shape and made of metal or the like.

The arm body 311 includes one end portion 311A pivotably supported by the side frame 83, the other end portion 311B to which the first spring 320 is connected, and an engaging hole 311C supporting the belt unit 82. The engaging hole 311C is disposed between the one end portion 311A and the other end portion 311B and configured to engage with the buffer member BF.

The arm body 311 further includes a guide protrusion 312 each extending toward the cam 340. The guide protrusion 312 is disposed between the other end portion 311B and the engaging hole 311C in a direction directed from the other end portion 311B toward the engaging hole 311C.

The cam follower 350 is mounted so as to be movable with respect to the guide protrusion 312 of the arm body 311, and the cam follower 350 can come into contact with the cam 340. The cam follower 350 includes a cylindrical portion 351 made of resin or the like and fitted into the guide protrusion 312, a contact portion 352 provided at one end of the cylindrical portion 351, and a flange portion 353 provided at the other end of the cylindrical portion 351.

The cylindrical portion 351 is supported by the guide protrusion 312 so as to be movable in a direction in which the guide protrusion 312 extends. The contact portion 352 is a wall configured to block an opening located at an end of the cylindrical portion 351 on the cam 340 side, and the contact portion 352 is disposed between the cam 340 and a distal end of the guide protrusion 312. The flange portion 353 protrudes from the other end of the cylindrical portion 351 in a direction orthogonal to the moving direction of the cam follower 350.

Then, the second spring 330 is disposed between the cylindrical portion 351 and the arm body 311. Accordingly, the arm body 311 is urged by the first spring 320 and can be urged by the second spring 330.

The first spring 320 is a spring configured to apply a first urging force to the belt unit 82. Specifically, the first spring 320 applies the first urging force to the belt unit 82 through the arm body 311.

More specifically, the first spring 320 urges the first pad PD1 and the second pad PD2 toward the roller 120 through the arm body 311, the buffer member BF, the first stay 210, and the holder 140. The first spring 320 is an extension coil spring made of metal or the like, one end of which is connected to the spring engaging portion 83A of the side frame 83 and the other end of which is connected to the other end portion 311B of the arm body 311.

The second spring 330 is a spring capable of applying a second urging force in a direction opposite to the first urging force to the belt unit 82. Specifically, the second spring 330 is capable of applying the second urging force to the belt unit 82 through the arm body 311. The second spring 330 is a compression coil spring made of metal or the like, and the second spring 330 is disposed between the cylindrical portion 351 and the arm body 311 in a state in which the guide protrusion 312 is inserted into a space surrounded by the compression coil spring.

The cam 340 is a member configured to switch a posture of the arm body 311 between a first posture and a second posture. The cam 340 is supported by the side frame 83 so as to be pivotable between a first cam position illustrated in FIG. 6A and a second cam position illustrated in FIG. 7A.

The cam 340 is made of resin or the like, and includes a first portion 341, a second portion 342, and a third portion 343. The first portion 341, the second portion 342, and the third portion 343 are located on an outer circumferential surface of the cam 340.

The first portion 341 is a portion nearest to the cam follower 350 of the first portion 341, the second portion 342 and the third portion 343 when the cam 340 is located at the first cam position. As illustrated in FIG. 6A, the first portion 341 is spaced apart from the cam follower 350 when the cam 340 is located at the first cam position.

The second portion 342 is a portion configured to come into contact with the cam follower 350 when the cam 340 pivots clockwise approximately 90 degrees from the first cam position in the drawing. A distance from the second portion 342 to a pivoting center of the cam 340 is greater than a distance from the first portion 341 to the pivoting center of the cam 340.

Figure 7A:
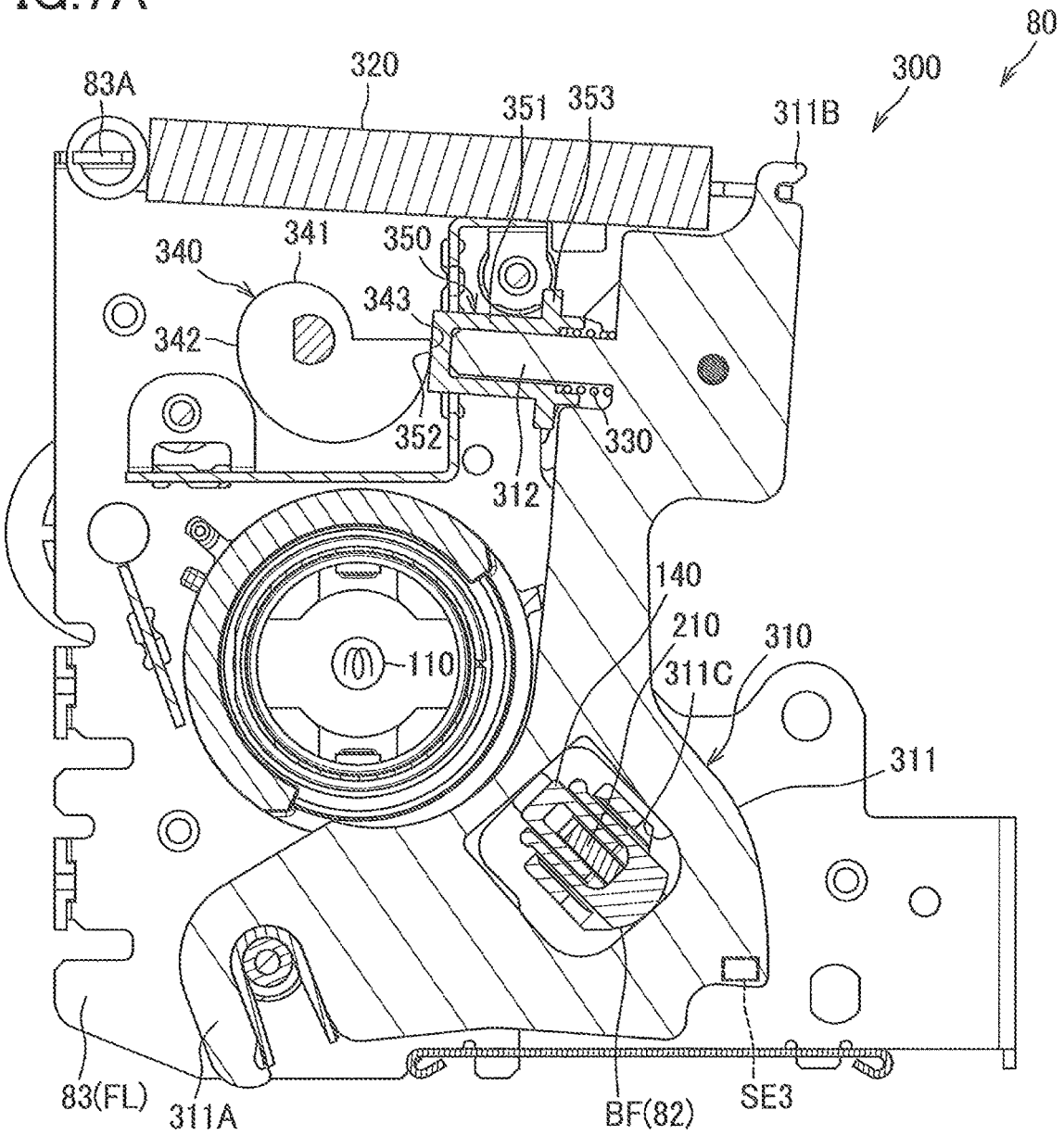
FIG. 7A is a cross-sectional view illustrating the pressure change mechanism obtained in a state in which the nip pressure is a first nip pressure.

The third portion 343 is a portion configured to come into contact with the cam follower 350 when the cam 340 is located at the second cam position. More specifically, the third portion 343 is a portion configured to come into contact with the cam follower 350 when the cam 340 pivots clockwise approximately 270 degrees from the first cam position in the drawing as illustrated in FIG. 7A. A distance from the third portion 343 to the pivoting center of the cam 340 is greater than the distance from the second portion 342 to the pivoting center of the cam 340.

When the cam 340 is located at the first cam position, the cam 340 is spaced apart from the cam follower 350. The arm body 311 is in the first posture illustrated in FIG. 6A when the cam 340 is spaced apart from the cam follower 350 as described above.

Specifically, the first urging force of the first spring 320 is applied to the belt unit 82 through the arm body 311 when the cam 340 is located at the first cam position. When the first urging force is applied to the belt unit 82 by the first spring 320 as described above, the nip pressure will be the second nip pressure P2.

In the case where the maximum nip pressure is the second nip pressure P2, the endless belt 130 is interposed between the first pressure pad N1/the second pressure pad N2 and the rotating member 81. An area where the nip pressure is the maximum nip pressure in the nip portion when the maximum nip pressure is the second nip pressure P2 is located in a range to be nipped between the second pressure pad N2 and the rotating member 81.

The first cam position is a position at which the nip pressure becomes the second nip pressure P2. The second cam position is a position at which the nip pressure becomes the first nip pressure P1.

When the cam 340 pivots from the first cam position illustrated in FIG. 6A to the second cam position illustrated in FIG. 7A, the cam 340 presses the arm body 311 through the cam follower 350 after moving the cam follower 350 with respect to the arm body 311. Accordingly, the arm body 311 pivots from the first posture to the second posture different from the first posture.

Figure 6B:
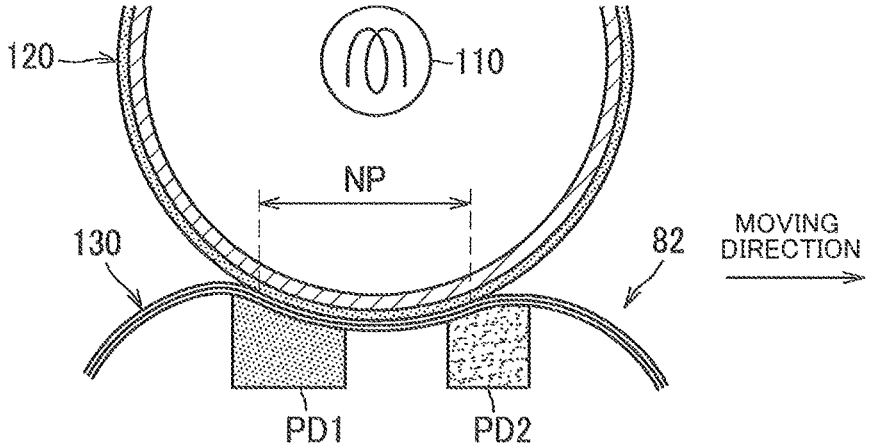
FIG. 6B is a cross-sectional view illustrating a configuration around a nip portion.

Accordingly, when the arm body 311 is in the second posture, the belt unit 82 is disposed at a position spaced apart from the roller 120 (a position of FIG. 7B) as compared with a position (a position of FIG. 6B) where the arm body 311 is in the first posture.

Figure 7B:
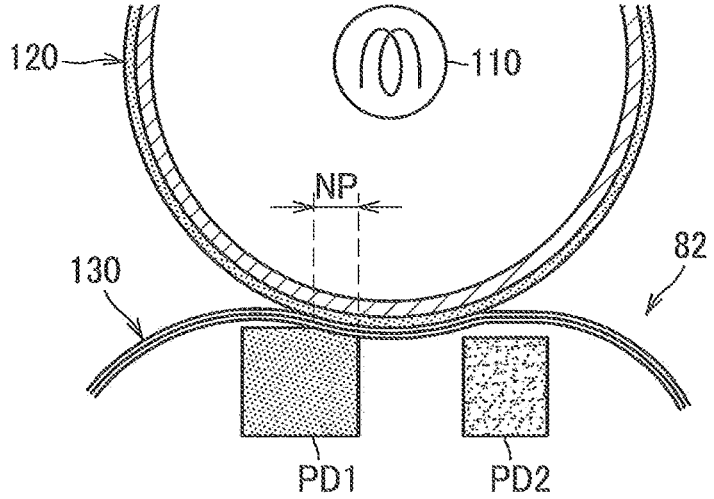
FIG. 7B is cross-sectional view illustrating a configuration around the nip portion.

Since the position of the belt unit 82 with respect to the roller 120 is changed as described above, when the cam 340 is located at the second cam position and the arm body 311 is in the second posture, a width of the nip portion NP is reduced as compared with the case where the arm body 311 is in the first posture as illustrated in FIG. 7B, and the nip pressure becomes the first nip pressure P1 which is the minimum nip pressure.

When the maximum nip pressure is the first nip pressure P1, the endless belt 130 is nipped between the first pressure pad N1 and the rotating member 81, and the endless belt is not nipped between the second pressure pad N2 and the rotating member 81. An area where the nip pressure is the maximum nip pressure in the nip portion when the maximum nip pressure is the first nip pressure P1 is located in a range nipped between the first pressure pad N1 and the rotating member 81.

Figure 8:
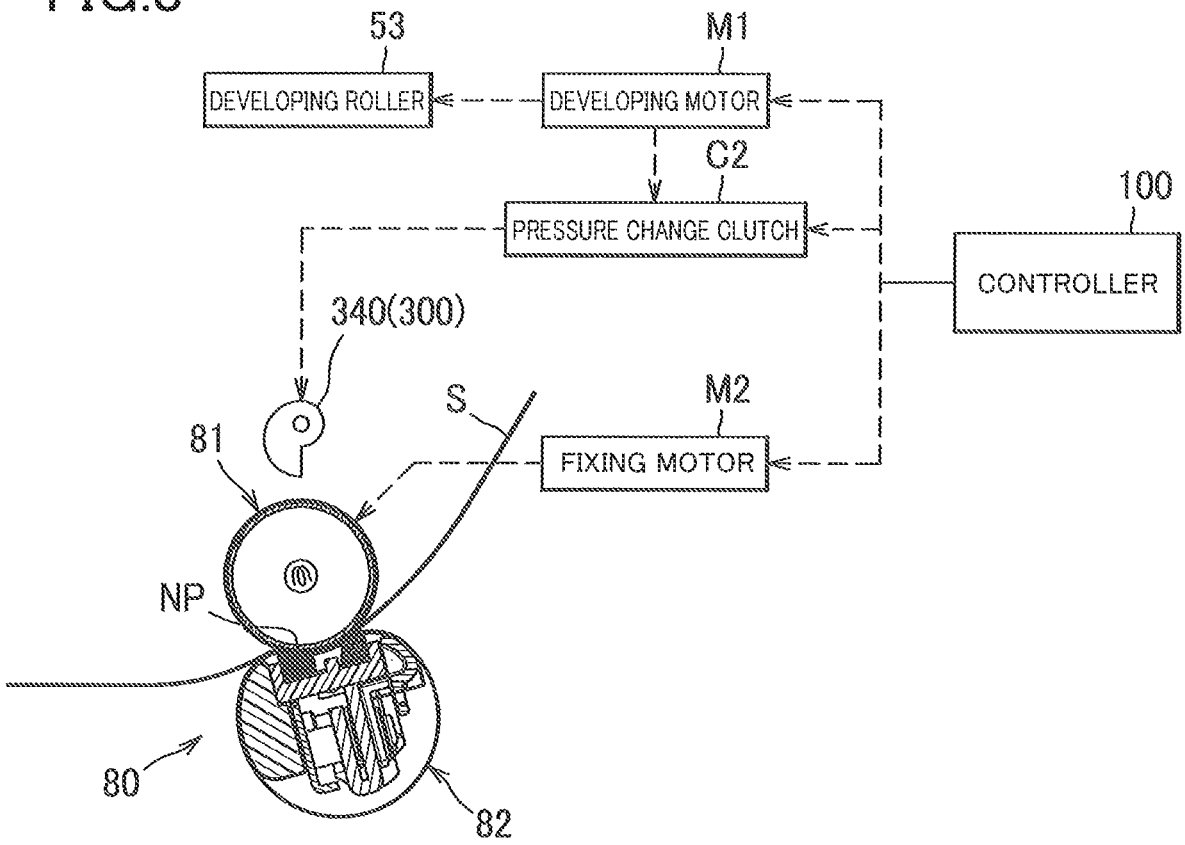
FIG. 8 is a view illustrating the relation between a controller and targets to be controlled by the controller.

As illustrated in FIG. 8, the color printer 1 further includes a developing motor M1, the fixing motor M2, and a pressure change clutch C2.

The developing motor M1 is a motor mainly configured to drive the respective developing rollers 53 to rotate, and the developing motor M is configured to rotate forwardly and reversely. The developing motor M1 is connected to the cam 340 of the pressure change mechanism 300 through the pressure change clutch C2 and a not-illustrated gear.

The fixing motor M2 is a motor configured to drive the roller 120 to rotate.

The pressure change clutch C2 is, for example, an electromagnetic clutch. The pressure change clutch C2 can switch between a second transmission state in which drive force of the developing motor M1 is transmitted to the cam 340 of the pressure change mechanism 300 and a second disconnected state in which drive force of the developing motor M1 is not transmitted to the cam 340 of the pressure change mechanism 300. When the pressure change clutch C2 becomes in the second transmission state in a case where the cam 340 is located at the second cam position and the developing motor M1 forwardly rotates, the cam 340 rotates counterclockwise in the drawing from the second cam position illustrated in FIG. 7A to the first cam position illustrated in FIG. 6A. When the pressure change clutch C2 becomes in the second transmission state in a case where the cam 340 is located at the first cam position and the developing motor M1 reversely rotates, the cam 340 rotates clockwise in the drawing from the first cam position illustrated in FIG. 6A to the second cam position illustrated in FIG. 7A.

As illustrated in FIG. 8, the controller 100 includes a CPU, a RAM, a ROM, a non-transitory memory, an ASIC, an input/output circuit, and the like. The controller 100 executes various processes by performing various calculation processes based on a print command received from an external computer, programs or data stored in the ROM and the like.

Next, a process to be executed when the controller 100 executes the fixing operation will be explained. The controller 100 sets the maximum nip pressure at the nip portion NP to the first nip pressure P1 when starting rotation of the rotation member 81. The controller 100 executes the fixing operation at the first nip pressure P1 when printing is executed on an envelope or a peculiar sheet, and executes the fixing operation at the second nip pressure P2 when printing is executed on plain paper and the like. Here, the process executed by the controller when printing is executed on plain paper and the like will be explained.

When receiving a print command, the controller 100 starts the rotation of the rotating member 81 at the first nip pressure P1 which is a lower nip pressure than a nip pressure used when executing the fixing operation, and changes the nip pressure to the second nip pressure which is the nip pressure used when executing the fixing operation after a peripheral velocity of the endless belt 130 becomes a predetermined velocity. The predetermined velocity is a velocity at which the fixing is executed.

Figure 9:
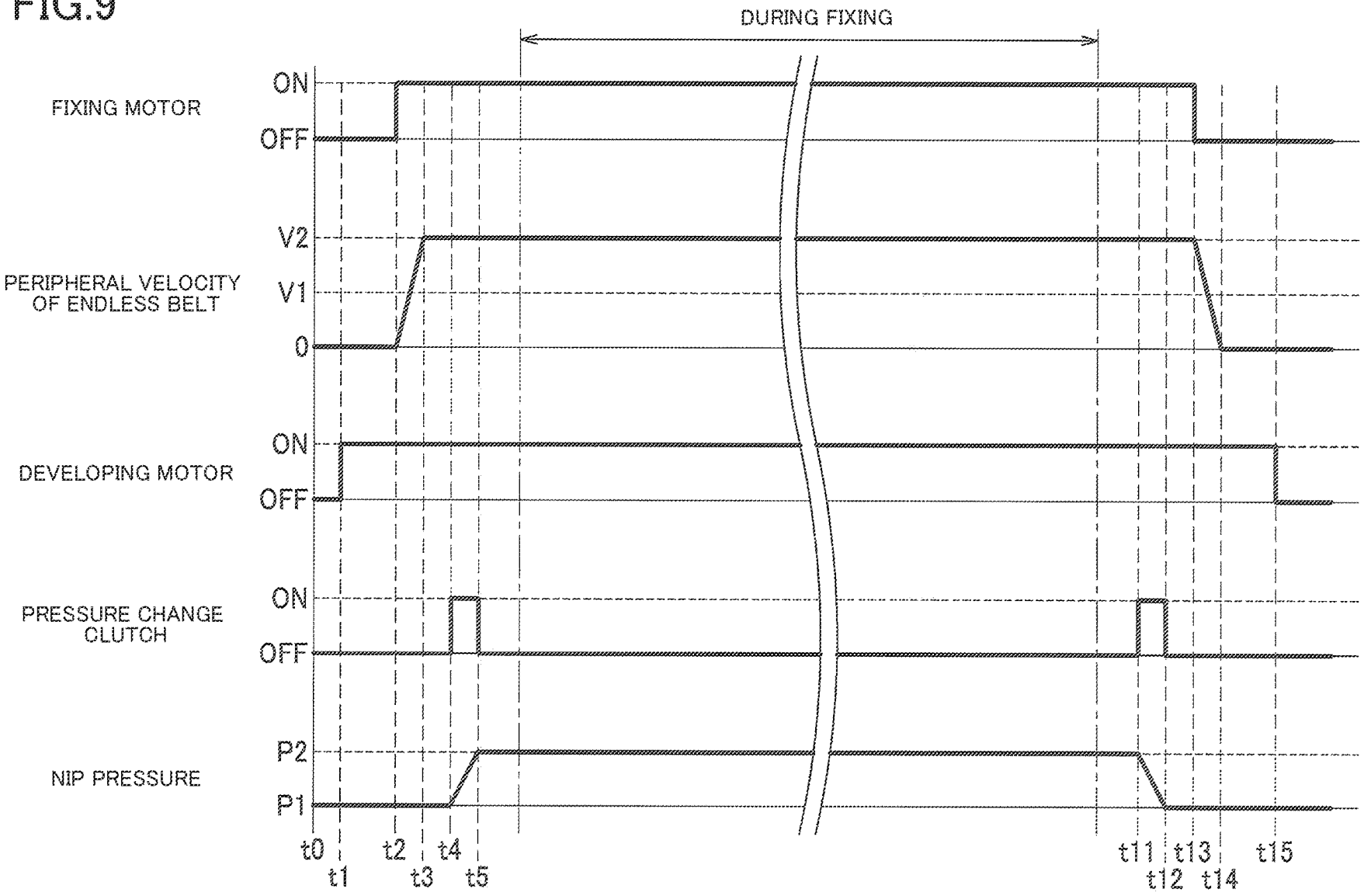
FIG. 9 is a timing chart illustrating an example of operations by the controller before and after fixing.

For example, as illustrated in FIG. 9, when the controller 100 receives a print command, the controller 100 starts driving of the developing motor M1 (time t1) in the state in which the nip pressure is set to the first nip pressure P1 (time t0), then, starts driving of the fixing motor M2 (time t2). After the peripheral velocity of the endless belt 130 becomes stable (time t3), the controller 100 drives the pressure change clutch C2 for a predetermined period (time t4 to t5), thereby changing the nip pressure from the first nip pressure P1 to the second nip pressure P2.

The controller 100, when ending the fixing operation and stopping the endless belt 130, reduces the nip pressure from the second nip pressure P2 to the first nip pressure P1, while maintaining the peripheral velocity of the endless belt 130 at the velocity used when executing the fixing operation, which is lower than the pressure used when executing the fixing operation, after that, stops the rotating member 81.

For example, the controller 100 drives the pressure change clutch C2 for a predetermined period (time t11 to t12) and changes the nip pressure from the second nip pressure P2 to the first nip pressure P1 when the fixing ends. Then, the controller 100 turns off the fixing motor M2 (time t13), and turns off the developing motor M1 (time t15) after the endless belt 130 stops (time t14).

As described above, the color printer 1 can change the maximum nip pressure at the nip portion NP at the time of executing the fixing operation between the first nip pressure P1 and the second nip pressure P2 higher than the first nip pressure P1. The color printer 1 can also execute image forming by rotating the endless belt 130 at a peripheral velocity of a first velocity V1 and at a second velocity V2 higher than the first velocity V1.

The controller 100 executes image forming at the first velocity V1 when executing printing on, for example, thick paper, glossy paper, label paper, and the like. The controller 100 executes image forming at the second velocity V2 when executing printing on, for example, plain paper, thin paper, and the like.

In the embodiment, the first velocity V1 [mm/sec], the second velocity V2 [mm/sec], the first nip pressure P1 [MPa], and the second nip pressure P2 [MPa] satisfy $V2/P2 \geq 200$, $V2/P1 \geq 200$, $V1/P1 \geq 200$, and $V1/P2 < 200$.

The controller 100 can execute a first fixing process in which the endless belt 130 is rotated at the peripheral velocity of the second velocity V2 and fixing is executed at the second nip pressure P2. The controller 100 can execute a second fixing process in which the endless belt 130 is rotated at the peripheral velocity of the second velocity V2 and fixing is executed at the first nip pressure P1. The controller 100 can execute a third fixing process in which the endless belt 130 is rotated at the peripheral velocity of the first velocity V1 and fixing is executed at the first nip pressure P1. On the other hand, the controller 100 does not execute a process in which the endless belt 130 is rotated at the peripheral velocity of the first velocity V1 and fixing is executed at the second nip pressure P2.

As described above, when executing the fixing operation in which a developer image is fixed by nipping the sheet S on which the developing image is formed between the rotating member 81 and the endless belt 130, the controller 100 controls the nip pressure and the peripheral velocity of the endless belt 130 so as to satisfy $V/P \geq 200$ when the peripheral velocity of the endless belt 130 is V [mm/sec] and the maximum nip pressure in nip pressures at the nip portion NP is P [MPa].

Next, actually measured values of V/P [mm/(MPa·sec)] and determination results of abnormal noise in the color printer 1 are illustrated in FIG. 10. The abnormal noise is noise to be heard when stick-slip occurs between the endless belt 130 and the sliding sheet 150. The peripheral velocity of the endless belt 130 was changed in five stages of 30, 60, 79.2, 120, and 240 [mm/sec]. The maximum nip portion at the nip portion NP was changed in three stages of 0.29, 0.38, and 0.43 [MPa]. The endless belt 130 and the sliding sheet 150 are both made of polyimide, and the grease GR is disposed between the endless belt 130 and the sliding sheet 150.

As illustrated in FIG. 10, abnormal noise was generated when V/P was equal to or less than 184 and abnormal noise was not generated when V/P was equal to or greater than 207. According to the result, it is found that abnormal noise is not generated and stick-slip does not occur when V/P≥200 is satisfied. On the other hand, it is found that abnormal noise is generated and stick-slip occurs when V/P<200 is satisfied.

According to the above, the following advantages can be obtained in the embodiment. When the fixing operation is executed between the rotating member 81 and the endless belt 130, the controller 100 of the color printer 1 controls the nip pressure and the peripheral velocity of the endless belt 130 so as to satisfy V/P≥200 when the peripheral velocity of the endless belt 130 is V [mm/sed] and the maximum nip pressure in nip pressures at the nip portion NP is P [MPa]. Accordingly, it is possible to suppress stick-slip which occurs between the endless belt 130 and the sliding sheet 150.

The controller 100 starts the rotation of the rotating member 81 at the nip pressure lower than the nip pressure used when executing the fixing operation when receiving the print command, and changes the nip pressure to the nip pressure used when executing the fixing operation after the peripheral velocity of the endless belt 130 becomes the velocity at the time of executing fixing. Accordingly, occurrence of stick-slip can be suppressed by reducing the nip pressure in the state in which the rotation velocity is low, that is, when the endless belt 130 is started. Although V/P≥200 is not satisfied just after starting the rotation of the endless belt 130 in this case; it is possible to suppress stick-slip which occurs between the endless belt 130 and the sliding sheet 150, because the maximum value of the nip pressure is lower than the pressure at the time of printing.

When the fixing operation is ended and the endless belt 130 is stopped, the controller 100 reduces the nip pressure to be lower than the pressure used when executing the fixing operation while maintaining the velocity of the endless belt 130 at the velocity used when executing the fixing operation, then, stops the rotating member 81. Accordingly, the occurrence of stick-slip can be suppressed.

The controller 100 does not execute a process in which the endless belt 130 is rotated at the first velocity V1 which is the peripheral velocity lower than the second velocity V2 and fixing is executed at the second nip pressure P2 higher than the first nip pressure P1. Accordingly, the occurrence of stick-slip can be suppressed.

The controller 100 also sets the maximum nip pressure at the nip portion NP to the first nip pressure P1 when starting the rotation of the rotating member 81. Since the nip pressure is low at the time of starting the fixing operation, the occurrence of stick-slip can be suppressed.

Moreover, the grease GR is disposed between the endless belt 130 and the sliding sheet 150, thereby suppressing the occurrence of stick-slip.

Since the opposed surface 151 of the sliding sheet 150 includes the plurality of recesses 153 which is not in contact with the endless belt 130, the occurrence of stick-slip can be suppressed.

The present disclosure is not limited to the above embodiment, and can be used in various manners as illustrated as examples below.

The photoconductive drum 51 is illustrated as an example of a photoconductor in the embodiment; however, the photoconductor is not limited to this in the present disclosure. For example, a belt-shaped photoconductor may be adopted.

The pressure change mechanism 300 is configured to change the nip pressure at the nip portion NP between the first nip pressure P1 and the second nip pressure P2 in the embodiment; however, the pressure change mechanism is not limited to this in the present disclosure. For example, the nip pressure may be changed to three or more pressure values or may be changed steplessly or linearly.

The present disclosure is applied to the color printer 1 in the above embodiment; however, the present disclosure is not limited to this. The present disclosure may be applied to other image forming apparatuses, which are, for example, a monochrome printer, a copy machine, a multifunction peripheral, and the like.

The halogen lamp is illustrated as an example of the heater in the embodiment; however, the heater may be, for example, a carbon heater and the like.

The configuration in which the heater is located inside the rotating member is illustrated as an example in the embodiment; however, the configuration is not limited to this in the present disclosure. The heater may be located inside the belt unit. For example, the belt unit may include the endless belt, the heater disposed inside the endless belt, and the nip member, and the rotating member may be a pressure roller is configured to cooperate with the nip member to nip the endless belt. Moreover, an external heating method in which the heater is disposed outside the rotating member to heat an outer circumferential surface of the rotating member or an IH (Induction Heating) method may be adopted. It is also preferable that the rotating member and the belt unit have heaters, respectively. That is, the heater may be configured to heat at least one of the rotating member and the endless belt.

The rotating member may be a belt containing the drive roller. That is, a configuration in which the nip portion is formed between the belt of the rotating member and the belt of the belt unit may be adopted.

The base material of the endless belt 130 and the base material of the sliding sheet 150 are both polyimide in the embodiment; however, the base material is not limited to this in the present disclosure. It is preferable that at least one of the base material of the endless belt 130 and the base material of the sliding sheet 150 is polyimide. For example, it is possible to adopt a configuration in which the base material of the endless belt 130 is made of polyimide and the base material of the sliding sheet 150 is made of another heat-resistant resin with a glass transition temperature of 140° C. or more. It is also possible to adopt a configuration in which the base material of the endless belt 130 is made of another heat-resistant resin with the glass transition temperature of 140° C. or more and the base material of the sliding sheet 150 is made of polyimide.

Furthermore, a configuration in which neither of the base material 1 of the endless belt 130 and the base material of the sliding sheet 150 is made of polyimide may be adopted. For example, the base material 1 of the endless belt 130 and the base material of the sliding sheet 150 may be polyetheretherketone (glass transition temperature 143° C.), polyetherimide (glass transition temperature 216° C.), polyamideimide (glass transition temperature 275° C.), and the like.

In the embodiment, the first velocity V1 [mm/sec], the second velocity V2 [mm/sec], the first nip pressure P1 [MPa], and the second nip pressure P2 [MPa] satisfy V2/P2≥200, V2/P1≥200, V1/P1≥200, and V1/P2<200; however, the present disclosure is not limited to this configuration. For example, when a configuration in which V1/P2≥200 is adopted, the controller 100 may allow a process in which the endless belt 130 is rotated at the peripheral velocity of the first velocity V1 and fixing is executed at the second nip pressure P2 to be executed.

The fixing device 80 is configured to have the pressure change mechanism 300 in the embodiment; however, the present disclosure is not limited to this configuration. It is also preferable that the body housing includes the pressure change mechanism, or a part of the pressure change mechanism is provided at the fixing device and other part of the pressure change mechanism are provided at the body housing.

Respective components explained in the above embodiment and modification examples may be arbitrarily combined to achieve the disclosure.

What is claimed is:

1. An image forming apparatus, comprising:

an endless belt made of heat-resistant resin not containing fluorine and having a glass transition temperature of 140° C. or more;

a roller configured to rotate the endless belt by rotating in a state in which the roller is in contact with an outer circumferential surface of the endless belt;

a heater configured to heat at least one of the roller and the endless belt;

a pressure pad configured to nip the endless belt between the pressure pad and the roller to form a nip portion; and a sliding sheet interposed between an inner circumferential surface of the endless belt and the pressure pad, the sliding sheet being made of heat-resistant resin not containing fluorine and having the glass transition temperature of 140° C. or more, wherein the image forming apparatus is configured to execute a fixing operation in which a developer image on a sheet is fixed in a state in which the sheet is nipped between the roller and the endless belt; and wherein a nip pressure at the nip portion P [MPa] and a peripheral velocity of the endless belt V [mm/sec] satisfies V/P≥200 when the image forming apparatus executes the fixing operation.

2. The image forming apparatus according to claim 1, wherein the image forming apparatus is configured to:

in response to reception of a print command, start rotation of the roller at a nip pressure less than a nip pressure used when executing the fixing operation; and after the peripheral velocity of the endless belt becomes a predetermined velocity, change the nip pressure to the nip pressure used when executing the fixing operation.

3. The image forming apparatus according to claim 2, wherein the predetermined velocity is a velocity used when the image forming apparatus executes the fixing operation.

4. The image forming apparatus according to claim 1, wherein, when stopping the endless belt to end the fixing operation, the image forming apparatus is configured to reduce the nip pressure to a pressure less than the pressure used when executing the fixing operation while maintaining the peripheral velocity of the endless belt at the velocity used when executing the fixing operation, and then, configured to stop the roller.

5. The image forming apparatus according to claim 1, wherein the image forming apparatus is capable of changing the nip pressure between a first nip pressure P1 [MPa] and a second nip pressure P2 [MPa] higher than the first nip pressure P1, and capable of rotating the endless belt at the peripheral velocity of a first velocity V1 [mm/sec] and a second velocity V2 [mm/sec] higher than the first velocity V1, wherein V1, V2, P1, and P2 satisfy V2/P2≥200, V2/P1≥200, V1/P1≥200, and V1/P2<200, wherein, when executing the fixing operation, the image forming apparatus is configured to execute, a first fixing process using the second velocity V2 and the second nip pressure P2, a second fixing process using the second velocity V2 and the first nip pressure P1, and a third fixing process using the first velocity V1 and first nip pressure P1, and wherein, when executing the fixing operation, the image forming apparatus does not execute a process using the first velocity V1 and the second nip pressure P2.

6. The image forming apparatus according to claim 1, wherein the image forming apparatus is capable of changing the nip pressure between a first nip pressure P1 [MPa] and a second nip pressure P2 [MPa] higher than the first nip pressure, wherein the pressure pad includes (i) a first pressure pad configured to nip the endless belt between the first pressure pad and the roller and (ii) a second pressure pad disposed downstream of the first pressure pad in a conveying direction of the sheet and configured to nip the endless belt between the second pressure pad and the roller, wherein, in a state in which the nip pressure is the first nip pressure P1, the endless belt is nipped between the first pressure pad and the roller while the endless belt is not nipped between the second pressure pad and the roller, and wherein, in a state in which the nip pressure is the second nip pressure P2, the endless belt is nipped between each of the first pressure pad and the second pressure pad and the roller.

7. The image forming apparatus according to claim 6, wherein the image forming apparatus is configured to set the nip pressure to the first nip pressure P1 when starting rotation of the roller.

8. The image forming apparatus according to claim 6, wherein the second pressure pad has a higher durometer hardness than the first pressure pad, and wherein an area where a maximum nip pressure is applied in the nip portion in a state in which the second nip pressure P2 is applied is located in a range which is nipped between the second pressure pad and the roller.

9. The image forming apparatus according to claim 1, wherein at least one of the endless belt and the sliding sheet is made of polyimide.

10. The image forming apparatus according to claim 1, wherein both the endless belt and the sliding sheet are made of polyimide.

11. The image forming apparatus according to claim 1, wherein grease is disposed between the endless belt and the sliding sheet.

12. The image forming apparatus according to claim 1, wherein the sliding sheet has a contact surface which is in contact with the endless belt, the contact surface having a plurality of recesses.

* * * * *